US006024484A

United States Patent [19]

Shaw

[11] Patent Number: 6,024,484

[45] Date of Patent: Feb. 15, 2000

[54] WATCH AND METHOD OF ASSEMBLING OF A WATCH

[75] Inventor: Philip Shaw, Portland, Oreg.

[73] Assignee: Nike, Inc., Beaverton, Oreg.

[21] Appl. No.: 08/867,089

[22] Filed: Jun. 2, 1997

[51] Int. Cl.[7] ..... G04B 29/00

[52] U.S. Cl. ..... 368/300; 368/88

[58] Field of Search ..... 368/10, 88, 84, 368/316, 297–300, 281, 282

[56] References Cited

U.S. PATENT DOCUMENTS

| | | | |
|---|---|---|---|
| 3,747,037 | 7/1973 | Earing | 336/96 |
| 3,756,013 | 9/1973 | Bergey et al. . | |
| 3,784,725 | 1/1974 | Perkins et al. . | |
| 3,903,223 | 9/1975 | Van Der Hock | 336/96 |
| 3,946,173 | 3/1976 | Haber . | |
| 4,082,927 | 4/1978 | Beckwith . | |
| 4,092,821 | 6/1978 | Wirz . | |
| 4,172,964 | 10/1979 | Reinebach | 336/96 |
| 4,194,351 | 3/1980 | Kume et al. . | |
| 5,015,801 | 5/1991 | Schaller et al. . | |
| 5,229,641 | 7/1993 | Katayama . | |
| 5,253,010 | 10/1993 | Oku et al. | 354/485 |
| 5,656,985 | 8/1997 | Lu et al. | 336/96 |

FOREIGN PATENT DOCUMENTS

| | | |
|---|---|---|
| 2 579 781 | 10/1986 | France . |
| 3834350A1 | 4/1989 | Germany . |
| 2149220 | 6/1985 | United Kingdom . |

*Primary Examiner*—Bernard Roskoski
*Attorney, Agent, or Firm*—Klarquist Sparkman Campbell Leigh & Whinston, LLP

[57] ABSTRACT

A watch has a controller and display held within a watch casing by filler. The watch can be assembled by positioning the controller and display within the watch casing and then adding the filler, which hardens to hold the controller and display in place and provide shock protection. The watch requires no special brackets or the like to hold the display and controller. As a result, it offers great flexibility in the design and shape of the watch casing and in the placement of control buttons. The watch is also easily assembled using automated manufacturing techniques.

10 Claims, 1 Drawing Sheet

WATCH AND METHOD OF ASSEMBLING OF A WATCH

FIELD OF THE INVENTION

The present invention relates to watches, and more particularly, to electronic watches having a printed circuit board housed within a watch case and to a method of assembling such watches.

BACKGROUND OF THE INVENTION

Electronic watches are accurate, reliable and offer a wide variety of features and options. Such watches typically contain a printed circuit board, a display and a battery housed within a watch casing. The printed circuit board carries the electronic circuitry necessary to control the display and the various functions of the watch. In addition, the printed circuit board includes connections for mechanical, push-button switches that allow a wearer to control the functions of the watch.

For years, the shape of a watch casing has been dictated largely by the printed circuit board, its related components, and the push-button switches. Moreover, because of the expense involved in designing and manufacturing printed circuit boards, a few standard circuit board designs were used by most watch manufacturers to manufacture most watches. For each of the standard circuit boards, the push-button switches had to be located to physically engage the printed circuit board at the proper location. As a result, flexibility in the placement of the push-button switches has been very limited.

Then, it was recognized that the switches could be hard-wired to the printed circuit board. Hardwiring allowed the push-button switches to be placed anywhere on the casing and still be coupled to the circuit board with a wire connection. This type of design permitted much more latitude in casing designs.

However, the design of varied and unique casings brought with it its own problems. If the casings were hollow shells into which the printed circuit boards fit, each casing required unique spacers and bracketry to hold the printed circuit board and other watch components in place.

If, on the other hand, the casings were made from resins molded around the printed circuit boards, such as in Kume et al., U.S. Pat. No. 4,194,351, then molds for forming the casing were required. If a flaw or blemish occurred in the casing as the resin set, the casing and the enclosed printed circuit board would be ruined and likely discarded. Moreover, the resin forming the casing must generally be heated to a relatively high temperature to achieve the necessary casing strength. This heating could damage the heat-susceptible printed circuit board inside. Also, the design of the casing was somewhat limited because the casing had to be shaped to allow removal of the mold.

Thus, a need exists for a watch and a method of assembling a watch that overcomes these inadequacies.

SUMMARY OF THE INVENTION

A watch in accordance with a preferred embodiment of the present invention is constructed so as to allow flexibility in design of the watch casing and to provide freedom in the placement of push-buttons.

In one aspect of the present invention, an electronic watch is provided with a controller, such as a printed circuit board, positioned within a watch casing. The controller is substantially surrounded by filler to hold it firmly in place within the casing. This structure allows flexibility in the placement of the controller within the casing and eliminates the need for special brackets and the like to hold the controller in place.

In another aspect of the invention, an electronic watch is assembled by positioning and holding a controller within a watch casing by, for example, a robotic arm. A first quantity of filler is then injected into the watch casing. The first quantity of filler is sufficient to hold the controller in place during subsequent assembly of the watch, thus allowing, for example, removal of the robotic arm. A second quantity of filler is then injected into the case to securely hold the controller in place. This method is well suited for use in constructing watches using a wide variety of watch casings of different shapes and sizes.

The foregoing and other objects and advantages of the invention will become more apparent from the following detailed description of the illustrated embodiment that is presented by way of example and not as a limitation of the present invention.

DETAILED DESCRIPTION OF ILLUSTRATED EMBODIMENTS

Figure 1:
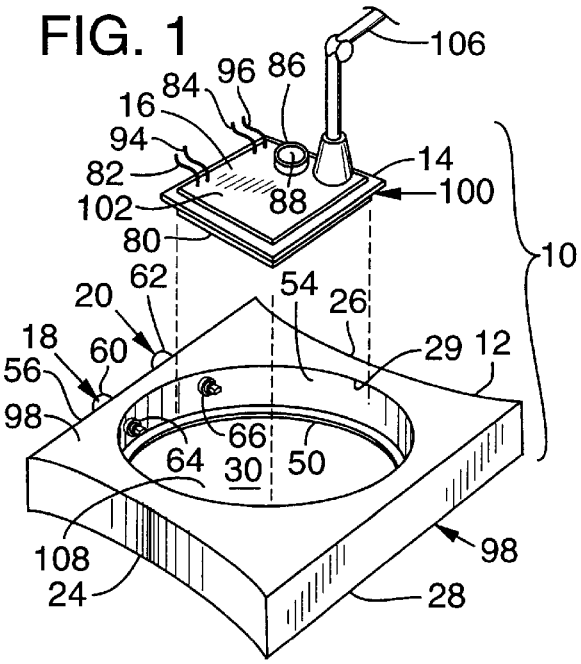
FIG. 1 is a perspective view of a watch casing showing a display and controller before being positioned within the watch casing, in accordance with a preferred embodiment of the present invention. The illustrated display and controller are assembled into a single unit and are held by a robotic arm in the illustration of FIG. 1.

An unassembled watch 10 in accordance with a preferred embodiment of the invention is shown in FIG. 1. The watch 10 includes a watch casing 12, a display 14 for displaying the time or other information, a controller 16 for controlling the display, and button switches 18 and 20 for activating the display or inputting commands to the controller. In the assembled watch, illustrated in FIG. 5, filler 22 holds the display 14 and controller 16 firmly in place within the casing 12.

The exemplary watch casing 12 shown in FIG. 1 is essentially square with two concave opposing sides 24, 26. However, it should be appreciated that one advantage of the present invention is that it allows for the design and use of watch casings having a wide variety of shapes. Thus, it is intended that any of a number of different watch casings could be used in the current invention.

The watch casing 12 may be formed by metal milling, injection molding, or other suitable techniques known to those skilled in the art. Injection molding preferably would use a hard resin, such as alkyl benzene sulfonate, nylon, or polyimide. For watch casings having relatively simple surfaces, metal injection molding could be used instead.

The watch casing 12 is provided with a finish by polishing, spray painting, or other suitable method. Preferably, the finishing is completed prior to assembling the watch. However, an advantage of this invention is that the finishing could be done after assembly.

The illustrated watch casing 12, which is shown with its front face 28 facing downward, has a central thru-hole 29. A display cover 30, such as a crystal, is positioned at the bottom of the thru-hole 29. Preferably, a gasket 32 (FIG. 3A) is provided to form a seal between the display cover 30 and the casing 12. The display cover 30 closes the bottom 50 of the thru-hole 29 to define a cavity 54 for housing the display 14 and the controller 16.

In the illustrated embodiment, two button switches 18 and 20 are positioned on one side 56 of the watch casing 12. However, the present invention allows great flexibility in the location and placement of button switches. Thus, the button switches could be positioned at different locations on the casing. In addition, a different number of button switches could be used, depending on the complexity and features of the watch. The button switches 18 and 20 each have a slidable button 60 and 62 which can be actuated by a user to input commands. Each button switch 18 and 20 is provided with a button contact 64 and 66, respectively, to allow an electrical connection between the controller 16 and the button switch.

The display 14 and the controller 16 are positioned within the cavity 54. The illustrated display 14 is a digital liquid crystal display of a type well known to those skilled in the art. Alternatively, the display could be an analog display, such as watch hands having a gearing assembly driver, or a combination analog/digital display.

A spacer 80 is positioned between the display cover 30 and the display 14. The illustrated spacer 80 seals the display 14 against the display cover and provides shock protection for the display 14 and controller 16. In analog watches, the spacer provides space between the display and the crystal for hands (not shown) and a center stem (not shown) around which the hands revolve. Preferably, the spacer is made of an elastic material, such as rubber and is shaped to mimic the periphery of the display, but sits a small distance inward from the periphery of the display.

The illustrated controller 16 is a printed circuit board. Electrical interconnects 82, 84, 94, and 96, such as wires, provide an electrical connection between the controller 16 and the button switches 18 and 20. In this manner, a user can actuate a button switch to provide a control signal to the controller.

A battery casing 86, having a cylindrical chamber 88 for containing a battery (not shown), is mounted to the controller 16. Preferably, positioning brackets (not shown) are used to retain the battery casing in the proper position on the controller. However, any standard mounting technique could be used. Appropriate electrical interconnects (not shown) are provided to electrically couple the battery to the controller.

In the illustrated embodiment, filler 22 is provided to hold the display 14 and controller 16 in place within the chamber 54. Preferably, the filler 22 substantially fills the chamber 54 so as to provide increased protection for the display and controller. However, in other embodiments, it may not be desirable to fill the chamber completely, so long as the display and controller are held in place sufficiently to permit proper operation of the watch during use.

Figure 3A:
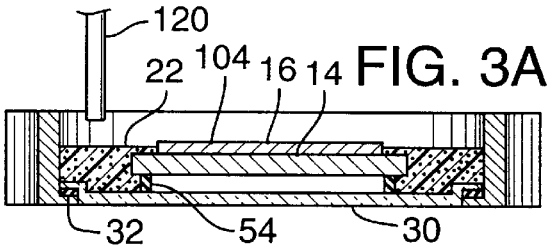
FIG. 3A is a cross-section view of the watch, taken along lines 3A—3A of FIG. 3.
Figure 3:
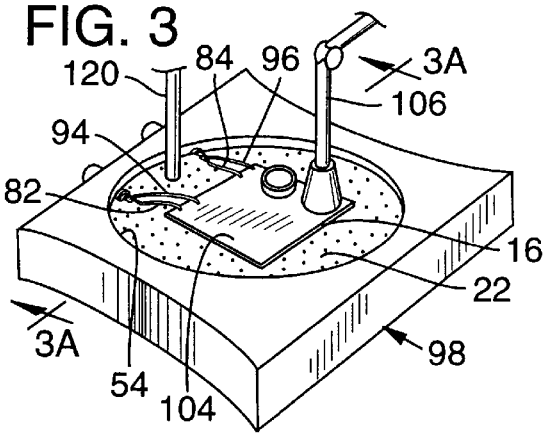
FIG. 3 is a perspective view similar to FIG. 2, showing a first quantity of filler being injected into the watch casing.
Figure 4:
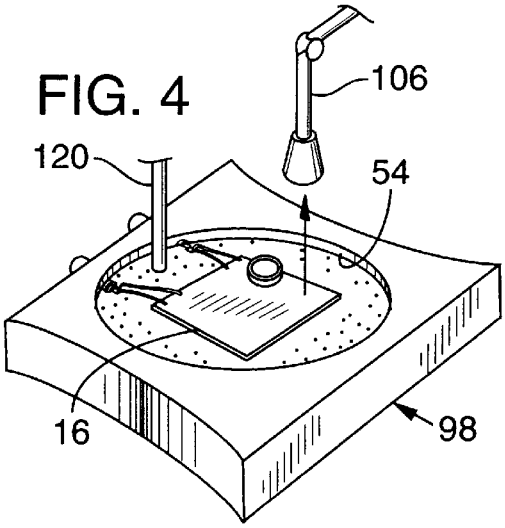
FIG. 4 is a perspective view similar to FIG. 3, showing the robotic arm being removed.
Figure 5:
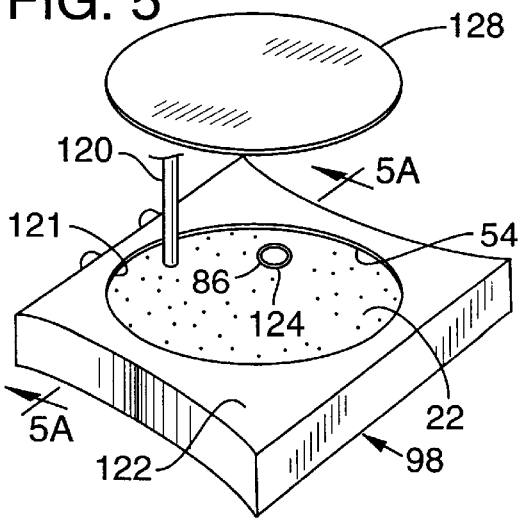
FIG. 5 is a perspective view similar to FIG. 4, showing a second quantity of filler being injected into the watch casing.
Figure 5A:
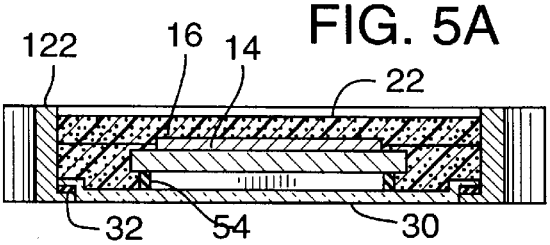
FIG. 5A is a cross-section view of the watch, taken along lines 5A—5A of FIG. 5, shown without the filler-injecting nozzle and watch back.

The filler preferably is foam, as depicted in FIGS. 3–5, but could also be resin or another material suitable for pouring, injecting, or otherwise depositing around the controller and the display to provide support and shock protection to the controller and the display.

In a preferred method of assembling the illustrated watch 10, the watch casing 12, the button switches 18 and 20, the display cover 30 and the gasket 32 are assembled into a watch casing assembly 98.

In addition, the spacer 80, display 14, controller 16 and battery casing 86 are assembled into a combined display and controller assembly 100. In assembling the combined display and controller assembly 100, the display 14 is mounted to the underside of the controller 16 by conventional surface-mount techniques, and the appropriate electrical connections are made between the display and the controller.

Once the watch casing assembly 98 and the combined display and controller assembly 100 are pre-assembled, the display and controller assembly 100 is inserted into the watch casing assembly 98. Filler is then injected into the cavity 54 to hold the display and controller assembly in place. In the illustrated embodiment, these steps are ideally suited for an automated manufacturing process. However, they could be performed manually instead.

In the illustrated embodiment, all components are back-loaded into the casing assembly. In other words, the components are placed in the casing assembly from the back 102.

Figure 2:
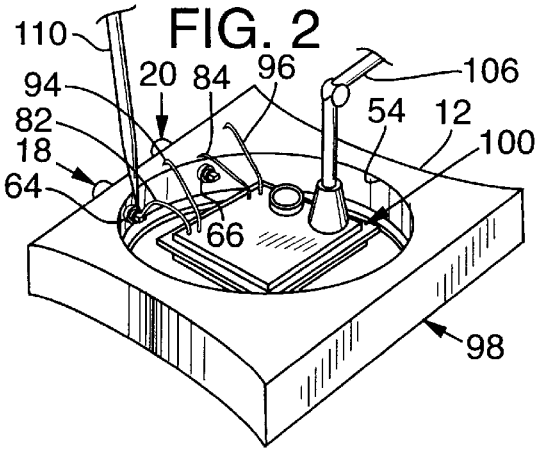
FIG. 2 is a perspective view similar to FIG. 1, showing the display and controller positioned within the watch casing and showing wires being connected between the controller and buttons on the watch casing.

Using an automated manufacturing process, as indicated in FIGS. 1 and 2, a robotic positioning arm 106 grasps the back face 104 of the controller 16, using suction or some other suitable technique, and places the combined display and controller assembly 100 in the cavity 54 in the watch casing 12. The robotic positioning arm 106 presses the combined display and controller assembly 100 against the casing 12 so that the spacer 80 is in sufficiently firm contact with the back face 108 of the display cover 30 to prevent filler 22 from seeping between the display cover and the combined display and controller assembly. Although a pressure contact between the spacer and the display cover is sufficient to prevent seepage of the filler, a tacky substance (not shown) applied to the spacer in the area where it contacts the display cover could also be used to help the seal and help hold the combined display and controller assembly in place before and during the addition of filler.

With the combined display and controller assembly 100 pressed firmly against the casing assembly 98, a robotic wirebonding arm 110 wirebonds the interconnects 82, 84, 94 and 96 to the contacts 64, 66, as shown in FIG. 2. The wirebonding arm then is moved away from the watch assembly area.

Then, a filler-injecting nozzle 120 fills the cavity 54 in the watch casing 12, as shown in FIGS. 3–5. Preferably, the filler 22 is non-conductive and rapid-hardening. The filler 22 both fixes the combined display and controller assembly 100 in place and provides shock protection for the assembly 100.

In the illustrated embodiment, filling the cavity with filler is completed in two stages. First, as shown in FIGS. 3, 3A, and 4, a first quantity of filler is injected into the cavity to fill only the portion of the cavity surrounding the combined display and controller assembly 100. The filling is stopped at a level just below the back face 104 of the controller 16, approximately 1.5 millimeters below the back face. The filler hardens sufficiently to hold the combined display and controller assembly in place. At which point, the positioning arm 106 disengages the combined display and controller assembly, as shown in FIG. 4, and preferably is moved out of the assembly area. It should be appreciated that the filling and the removal of the positioning arm need not occur discretely, but could be simultaneous.

Next, as shown in FIGS. 5 and SA, the filler-injecting nozzle 120 injects a second quantity of filler 22 which nearly fills the remainder of the cavity. Preferably, a small space 121, approximately 0.5 millimeters in the illustrated embodiment, is left between the back surface 122 of the case 12 and the top of the filler 22. With the filler 22 at this level, the back 124 of the battery casing 86 is exposed, and thus the battery holding chamber 88 remains accessible.

The watch 10 then is sent through a rapid-drying chamber (not shown) to properly set the filler 22 and ensure that no excess moisture remains in the filler. The battery (not shown) is placed in the battery casing 86, and a watch back 128 is assembled to the back surface 122 of the casing 12 to enclose the filler. The illustrated watch back has a pre-cut spacer (not shown), preferably of polypropylene, that fills the top, unfilled small space 121 of the cavity 54 to provide pressure on the filler to ensure a tight fit of the internals to the watch casing 12 and to provide pressure on the battery to ensure it stays in contact with the battery casing.

Because the filler 22 is injected into the casing 12 and spreads to fill the shape of the cavity 54, this method of assembly permits innumerable variations in the casing size and shape. Also, because a robotic arm 106 is used to place and temporarily hold the combined display and controller assembly 100 in the watch casing 12, no tooling changes or additional bracketry are required when different size watch casings are used.

This description sets forth embodiments of the present invention for purposes of illustration only. The description should not be construed to limit the scope of the invention in any way. Numerous other modifications and variations can be made to the invention without departing from the invention as defined by the appended claims and their equivalents.

The invention claimed is:

1. A watch comprising:

a watch casing having a front face and a back surface and defining a cavity, the cavity having an internal surface, the watch casing further defining a display opening within the front face;

a display visible through the display opening;

a controller for controlling the display, the controller positioned within the cavity and mounted to the display; and filler filling space between the display and a level between the display and the rear surface, the filler being in contact with at least a portion of the controller between said level and the display and extending radially therefrom to contact the internal surface between said level and the display to hold the controller in position within the watch casing.

2. The watch of claim 1 in which the filler is deposited in the watch casing by injection of a flowable material into the casing, the flowable material conforming to the contours of at least a substantial portion of the internal surface of the cavity and the controller before hardening to form the filler.

3. The watch of claim 1 further comprising:

a display cover positioned within the display opening; and a spacer located between the display and display cover to prevent filler from seeping between the display and the display cover.

4. The watch of claim 1 further comprising at least one button carried on the watch casing, said button having at least one electrical contact in electrical connection with the controller whereby actuation of the button provides an electrical signal to the controller.

5. The watch of claim 1 in which the filler is a non-conductive and rapid-hardening foam.

6. The watch of claim 1 further comprising a watch back covering the cavity, the back having a back spacer that protrudes into the cavity and contacts the filler.

7. A watch comprising:

a watch casing having a front face and a rear surface, the watch casing further defining a cavity having in internal surface and having a display opening within the front face;

a display visible through the display opening;

a display cover positioned within the display opening;

a button carried on the watch casing;

a controller for controlling the display, the controller mounted to the display and positioned within the cavity;

filler formed of a hardened flowable material, said fillng space between the display and a level between the display and the rear surface, the filler being in contact with at least a portion of the controller between said level and the display and extending radially therefrom to contact the internal surface between said level and the display to hold the controller in position within the cavity;

a spacer located between the display and the display cover to prevent the filler from seeping between the display and the display cover; and an electrical connector having a first end electrically coupled to the button and a second end electrically coupled to the controller.

8. The watch of claim 7 in which at least a portion of the electrical connector is encased within the filler.

9. The watch of claim 8 in which the electrical connector is a wire.

10. The watch of claim 9 in which the first end of the electrical connector is soldered to the button assembly.

* * * * *